US010215046B2

(12) United States Patent
Tatton

(10) Patent No.: US 10,215,046 B2
(45) Date of Patent: Feb. 26, 2019

(54) AIRFOIL PLATFORM HAVING DUAL PIN APERTURES AND A VERTICAL STIFFENER

(71) Applicant: United Technologies Corporation, Farmington, CT (US)

(72) Inventor: Royce E. Tatton, Blackfoot, ID (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 593 days.

(21) Appl. No.: 14/948,638

(22) Filed: Nov. 23, 2015

(65) Prior Publication Data

US 2017/0145838 A1 May 25, 2017

(51) Int. Cl.
*F01D 5/32* (2006.01)
*F01D 11/00* (2006.01)
*F01D 5/30* (2006.01)

(52) U.S. Cl.
CPC ..... *F01D 11/008* (2013.01); *F01D 5/3007* (2013.01); *F01D 5/3053* (2013.01); *F01D 5/326* (2013.01); *F05D 2220/32* (2013.01); *F05D 2220/36* (2013.01); *F05D 2230/20* (2013.01); *F05D 2240/80* (2013.01); *F05D 2260/30* (2013.01); *F05D 2300/6012* (2013.01)

(58) Field of Classification Search
CPC ..... F01D 5/326; F01D 11/08; F04D 29/324; F04D 29/322
See application file for complete search history.

(56) References Cited

U.S. PATENT DOCUMENTS 5,049,035 A * 9/1991 Marlin ..... F01D 5/22 416/193 A
6,447,250 B1 * 9/2002 Corrigan ..... F01D 5/3007 416/193 A
9,017,031 B2 * 4/2015 Bottome ..... F01D 11/008 416/193 R
9,267,386 B2 * 2/2016 Turner ..... F01D 11/008
9,399,922 B2 * 7/2016 Lamboy ..... F01D 5/3007
2008/0273980 A1 11/2008 Belmonte et al.
2009/0208335 A1 * 8/2009 Bottome ..... F01D 11/008 416/179
2010/0150724 A1 * 6/2010 Forgue ..... F01D 5/3007 416/219 R
2010/0290910 A1 * 11/2010 Hoyland ..... F01D 11/008 416/193 R

FOREIGN PATENT DOCUMENTS

EP 3121386 1/2017

OTHER PUBLICATIONS

European Search Report, European Application No. 16200339.6-1610, dated Apr. 6, 2017, European Patent Office; European Search Report 11 pages.

* cited by examiner

*Primary Examiner* — Woody A Lee, Jr.
(74) *Attorney, Agent, or Firm* — Cantor Colburn LLP

(57) ABSTRACT

A platform for an airfoil in a gas turbine engine is provided. The platform includes a top wall configured to connect to an airfoil of the gas turbine engine, two sidewalls extending downward from the top wall a connector attached to and connecting the two sidewalls, wherein the top wall, the sidewalls, and the connector define an interior volume of the platform, and a single stiffener extending from the connector to the top wall within the interior volume between the two sidewalls. The connector defines two parallel apertures passing through the connector.

17 Claims, 6 Drawing Sheets

AIRFOIL PLATFORM HAVING DUAL PIN APERTURES AND A VERTICAL STIFFENER

BACKGROUND

The subject matter disclosed herein generally relates to airfoil platforms used in gas turbine engines and, more particularly, to airfoil platforms having dual pin apertures and a vertical stiffener.

Gas turbine engines generally include a fan section, a compressor second, a combustor section, and turbine sections positioned along a centerline referred to as an "axis of rotation." The fan, compressor, and combustor sections add work to air (also referred to as "core gas") flowing through the engine. The turbine extracts work from the core gas flow to drive the fan and compressor sections. The fan, compressor, and turbine sections each include a series of stator and rotor assemblies. The stator assemblies, which do not rotate (but may have variable pitch vanes), increase the efficiency of the engine by guiding core gas flow into or out of the rotor assemblies.

The fan section includes a rotor assembly and a stator assembly. The rotor assembly of the fan includes a rotor disk and a plurality of outwardly extending rotor blades. Each rotor blade includes an airfoil portion, a dove-tailed root portion, and a platform. The airfoil portion extends through the flow path and interacts with the working medium gases to transfer energy between the rotor blade and working medium gases. The dove-tailed root portion engages attachment means of the rotor disk. The platform typically extends circumferentially from the rotor blade to a platform of an adjacent rotor blade. The platform is disposed radially between the airfoil portion and the root portion. The stator assembly includes a fan case, which circumscribes the rotor assembly in close proximity to the tips of the rotor blades.

To reduce the size and cost of the rotor blades, the platform size may be reduced and a separate fan blade platform may be attached to the rotor disk. To accommodate the separate fan blade platforms, outwardly extending tabs may be forged onto the rotor disk to enable attachment of the platforms. Pins may be used to attach the platforms to the root portions.

The aspect ratio of the fan flow path can be such that it restricts the diameter of the pin that attaches the fan platform to the fan rotor. The pin must travel with some clearance under the leading edge of the platform and above the fan rotor in order to be fully installed. Certain requirements may be that the center of gravity of the fan platform assembly be within a certain tangential distance of the pin to reduce rotation of the platform about the pin centerline and reduce loading on the adjacent fan blades.

SUMMARY

According to one embodiment, a platform for an airfoil in a gas turbine engine is provided. The platform includes a top wall configured to connect to an airfoil of the gas turbine engine, two sidewalls extending downward from the top wall, a connector attached to and connecting the two sidewalls, wherein the top wall, the sidewalls, and the connector define an interior volume of the platform, and a single stiffener extending from the connector to the top wall within the interior volume between the two sidewalls. The connector defines two parallel apertures passing through the connector.

In addition to one or more of the features described above, or as an alternative, further embodiments of the platform may include that the platform has a front end and a rear end, and wherein the two parallel apertures extend through the connector from the front end to the rear end.

In addition to one or more of the features described above, or as an alternative, further embodiments of the platform may include that the two parallel apertures are configured to receive substantially identical pins therethrough.

In addition to one or more of the features described above, or as an alternative, further embodiments of the platform may include two substantially identical pins installed in the two parallel apertures.

In addition to one or more of the features described above, or as an alternative, further embodiments of the platform may include that the stiffener is connected to the connector at a point between the two parallel apertures of the connector.

In addition to one or more of the features described above, or as an alternative, further embodiments of the platform may include that the connector defines a bottom wall of the platform.

According to another embodiment, a method of manufacturing a platform for an airfoil in a gas turbine engine is provided. The method includes forming a connector of a platform with two parallel apertures passing therethrough, forming two sidewalls extending upward from the connector, forming a top wall opposite the connector, wherein the top wall, the sidewalls, and the connector define an interior volume of the platform, and forming a single stiffener extending from the top wall to the connector within the interior volume between the two sidewalls.

In addition to one or more of the features described above, or as an alternative, further embodiments of the method may include that the platform has a front end and a rear end, and wherein the two parallel apertures are formed to extend through the connector from the front end to the rear end.

In addition to one or more of the features described above, or as an alternative, further embodiments of the method may include that the two parallel apertures are formed to receive substantially identical pins therethrough.

In addition to one or more of the features described above, or as an alternative, further embodiments of the method may include installing two substantially identical pins through the two parallel apertures.

In addition to one or more of the features described above, or as an alternative, further embodiments of the method may include that the stiffener is formed to connect to the connector at a point between the two parallel apertures of the connector.

In addition to one or more of the features described above, or as an alternative, further embodiments of the method may include that the connector defines a bottom wall of the platform.

In addition to one or more of the features described above, or as an alternative, further embodiments of the method may include that the top wall, the sidewall, the connector, and the stiffener are formed substantially simultaneously.

In addition to one or more of the features described above, or as an alternative, further embodiments of the method may include that the top wall, the sidewall, the connector, and the stiffener are formed by a layup process.

According to another embodiment, a gas turbine engine is provided. The engine includes a rotor, at least one airfoil, and a platform configured to connect the at least one airfoil to the rotor. The platform includes a top wall configured to connect to an airfoil of the gas turbine engine, two sidewalls extending downward from the top wall, a connector attached to and connecting the two sidewalls, wherein the top wall, the sidewalls, and the connector define an interior volume of the platform, and a single stiffener extending from the connector to the top wall within the interior volume between the two sidewalls. The connector defines two parallel apertures passing through the connector.

In addition to one or more of the features described above, or as an alternative, further embodiments of the engine may include that the platform has a front end and a rear end, and wherein the two parallel apertures extend through the connector from the front end to the rear end.

In addition to one or more of the features described above, or as an alternative, further embodiments of the engine may include that the two parallel apertures are configured to receive substantially identical pins therethrough.

In addition to one or more of the features described above, or as an alternative, further embodiments of the engine may include two substantially identical pins installed in the two parallel apertures.

In addition to one or more of the features described above, or as an alternative, further embodiments of the engine may include that the stiffener is connected to the connector at a point between the two parallel apertures of the connector.

In addition to one or more of the features described above, or as an alternative, further embodiments of the engine may include that the connector defines a bottom wall of the platform.

Technical effects of embodiments of the present disclosure include a platform used in a gas turbine engine having two parallel apertures forming in a connector thereof. Further technical effects include having two pins configured to install into two parallel apertures of a platform to provide stability and/or structural integrity.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
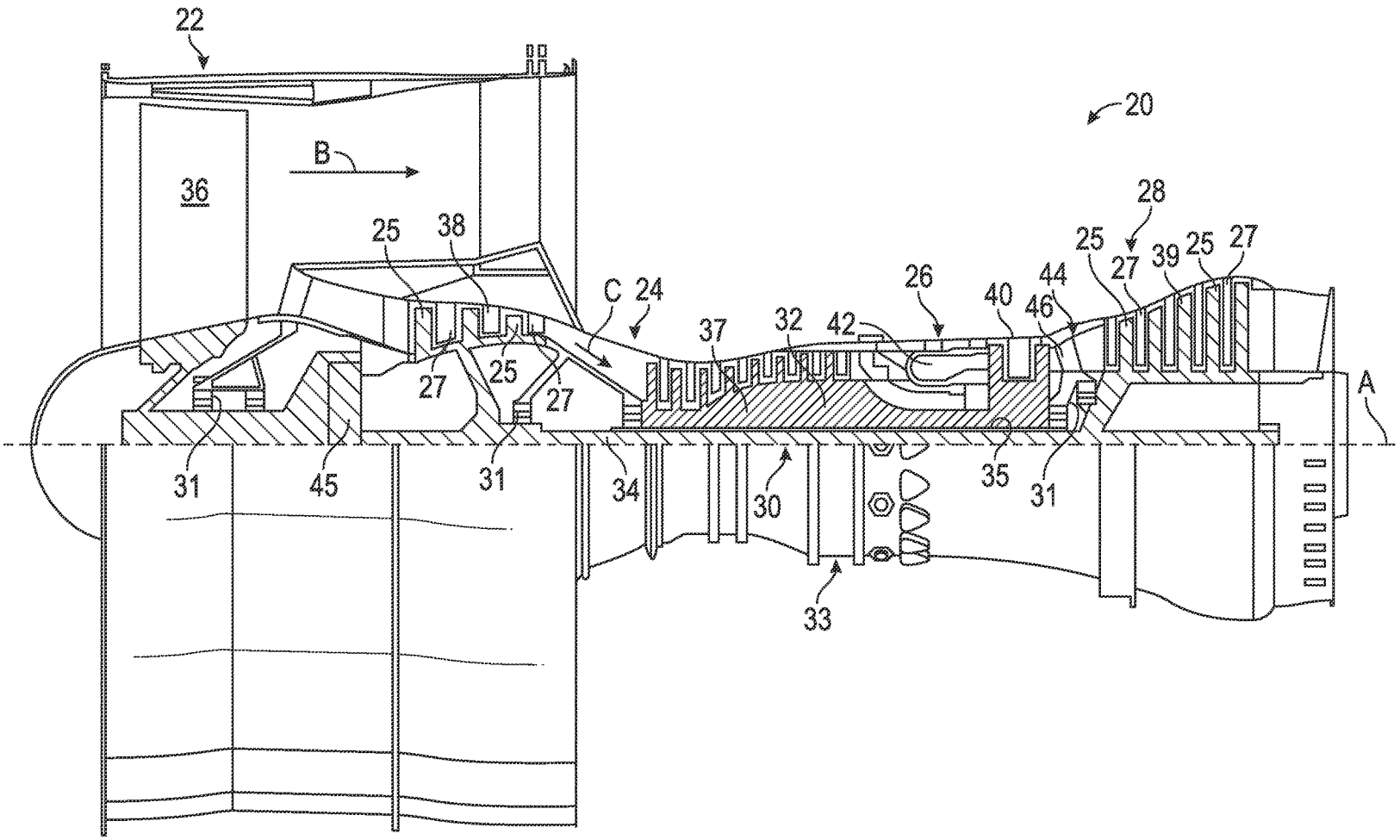
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of [(Tram° R)/(518.7° R)]0.5, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
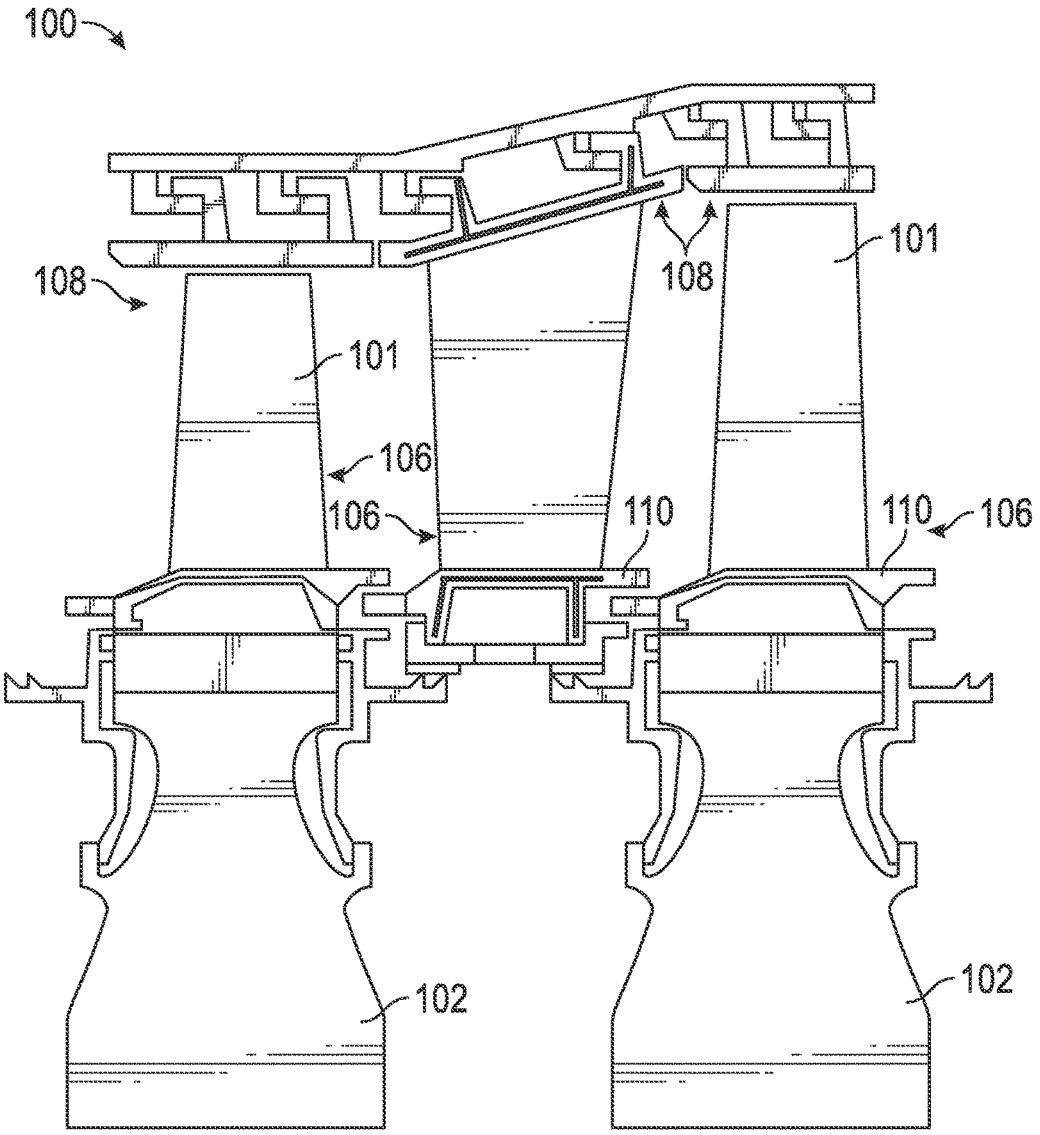
FIG. 1B is a schematic illustration of a turbine that may employ various embodiments disclosed herein.

FIG. 1B is a schematic view of a turbine section that may employ various embodiments disclosed herein. Turbine 100 includes a plurality of airfoils 101 that may be blades of rotor sections of a gas turbine engine. The airfoils 101 may be mounted to a rotor 102

The airfoils 101 may be hollow bodies with internal cavities defining a number of channels or cavities, hereinafter airfoil cavities, formed therein and extending from an inner diameter 106 to an outer diameter 108, or vice-versa. The airfoil cavities may be separated by partitions within the airfoils 101 that may extend either from the inner diameter 106 or the outer diameter 108 of the airfoil 101. The partitions may extend for a portion of the length of the airfoil 101, but may stop or end prior to forming a complete wall within the airfoil 101. Thus, each of the airfoil cavities may be fluidly connected and form a fluid path within the respective airfoil 101. The blades 101 and the vanes may include platforms 110 located proximal to the inner diameter thereof. The platforms 110 may provide a connection between the rotor 102 and the airfoil 101.

Figure 2:
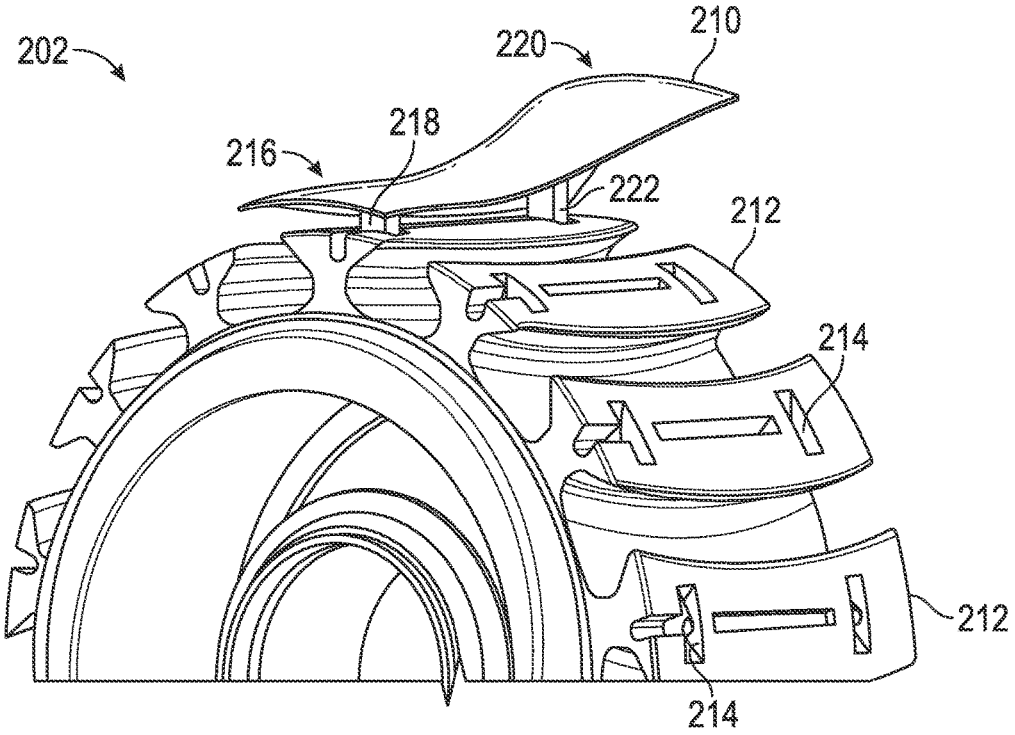
FIG. 2 is a perspective view of a fan rotor including a plurality of blade root attachment lugs and a blade platform.

Turning now to FIG. 2, illustrated is a perspective view of a fan rotor 202 that may be located within a fan section of a gas turbine engine. As shown, the fan rotor 202 includes at least one blade root attachment lug 212. During installation of the fan section, a fan blade platform 210 is operably coupled to each of the blade root attachment lugs 212. As shown, each of the blade root attachment lug 212 may include one or more slots 214 that are configured to receive a portion of a platform 210. For example, as shown, a front end 216 of the platform 210 may include a first connector 218 that may engage within a respective first cavity 214, and at back end 220 of the platform 210, a second connector 222 may engage with a respective second cavity 214. A locking pin (not shown) may be used to provide removable attachment between the platform 210 and the blade root attachment lug 212.

Figure 3:
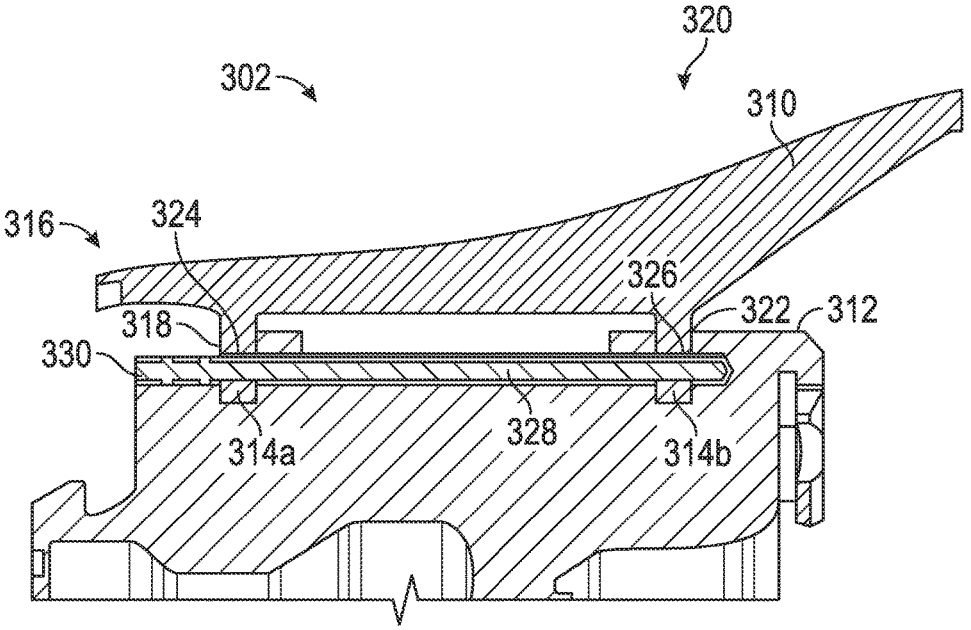
FIG. 3 is a cross-sectional illustration of a blade platform as engaged with a blade root attachment lug.

Turning now to FIG. 3, a cross-sectional schematic view of a portion of a fan rotor 302 is shown. During installation of a fan section of a gas turbine engine, a fan blade platform 310 may be operably coupled to each of the blade root attachment lugs 312 of the fan rotor 302. Each platform 310 may include at least one connector, e.g., first connector 318 and second connector 322, extending from a bottom of the platform 310. Each of the at least one connectors 318, 322 include an aperture 324, 326, respectively, formed therethrough.

To secure the platform 310 to a respective blade root attachment lug 312, the first connector 318 is inserted into a first cavity 314*a* at a front end 316, and the second connector 322 is inserted into a second cavity 314*b* at a back end 320. A pin 328 may be inserted through a blade root attachment lug aperture 330 to pass through each of the apertures 324, 326 of the platform 310 in the first connector 318 and the second connector 322.

Figure 4A:
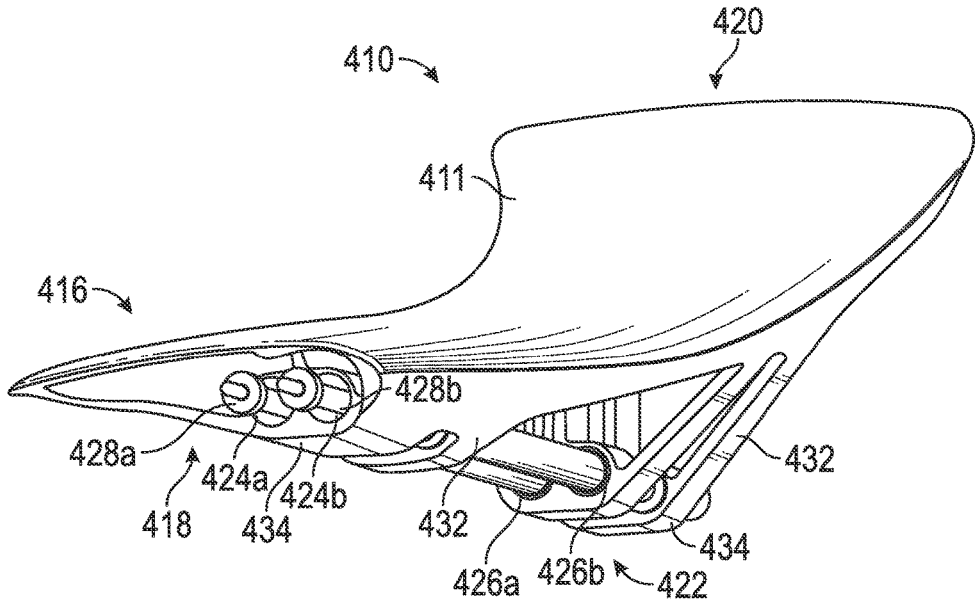
FIG. 4A is a front end perspective schematic illustration of a platform in accordance with an embodiment of the present disclosure.
Figure 4B:
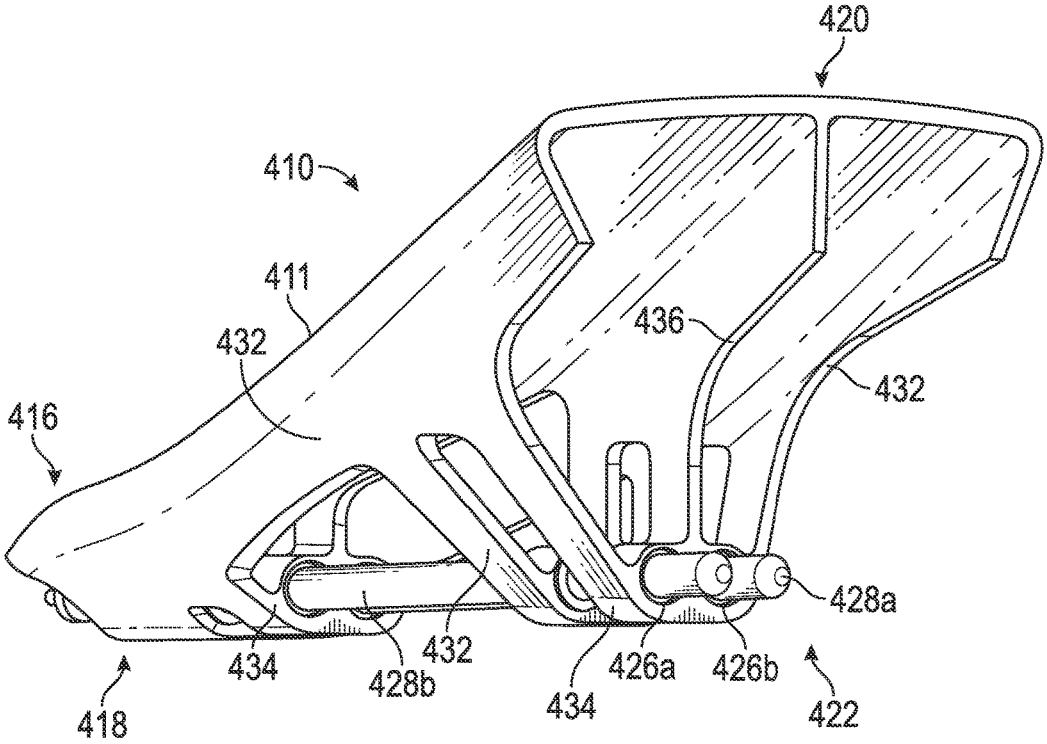
FIG. 4B is a rear end perspective schematic illustration of the platform of FIG. 4A.
Figure 4C:
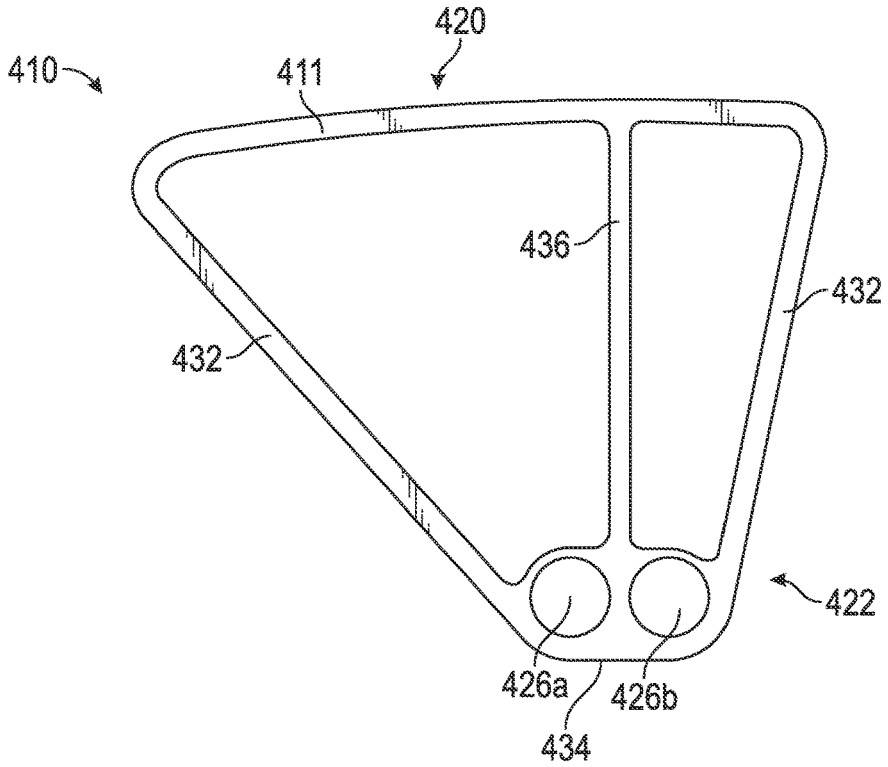
FIG. 4C is a rear elevation schematic illustration of the platform of FIG. 4A.

Turning now to FIGS. 4A-4C, various schematic views of a platform in accordance with a non-limiting embodiment of the present disclosure are shown. FIG. 4A shows a perspective front schematic view of a platform 410; FIG. 4B shows a perspective rear schematic view of the platform 410; and FIG. 4C shows a rear elevation schematic view of the platform 410.

As shown, the platform 410 includes a top wall 411 with a front end 416 and a rear end 420. The top wall 411 defines a flow path surface and is configured to attach to and/or support an airfoil thereon. Extending downward from the top wall 411 are two sidewalls 432. The sidewalls 432 may connect the top wall 411 with one or more connectors 418, 422, and define an interior of the platform therebetween. The connectors 418, 422 may each respectively include two adjacent apertures. For example, as shown, a first connector 418 includes a first aperture 424*a* and a second aperture 424*b* positioned side-by-side within the first connector 418. Similarly, a second connector 422 includes a first aperture 426*a* and a second aperture 426*b* positioned side-by-side within the second connector 422.

The first apertures 424*a*, 426*a* of each connector 418, 422 may be axially aligned such that a first pin 428*a* may be inserted into the first apertures 424*a*, 426*a*. Similarly, the second apertures 424*b*, 426*b* of each connector 418, 422 may be axially aligned such that a second pin 428*b* may be inserted into the second apertures 424*b*, 426*b*. As such, the platform 410 includes two apertures that extend parallel to each other through the connectors of the platform 410.

As will be appreciated by those of skill in the art, the connectors 418, 422 may be wider than a single-aperture connector to accommodate the dual apertures (424*a*, 424*b* and 426*a*, 426*b*, respectively). As such, the connectors 418, 422 may define a bottom wall 434. The bottom wall 434 may be discontinuous, as shown in FIG. 4A, or may be a continuous wall extending from the front end 416 to the rear end 420 at the bottom of the platform 410.

Turning now to FIG. 4B, a rear perspective view of the platform 410 is shown. In addition to showing an alternative view of the features described above, FIG. 4B shows a stiffener 436 extending from the top wall 411 to the connector 422 at the rear end 420 of the platform 410 and located in an interior space or volume of the platform 410. As shown, the stiffener 436 is located within the platform 410 and between the sidewalls 432 of the platform 410. A second stiffener may be located at the front end 416 of the platform 410 (not labeled).

Turning now to FIG. 4C, the parallel, side-by-side apertures 426*a*, 426*b* are shown formed through the connector 422 at the rear end 420 of the platform 410. Further, the stiffener 436 is shown extending from the top wall 411 to the connector 422, with the stiffener 436 joining the connector 422 at a position between the two apertures 426*a*, 426*b*. That is, in some embodiments, the stiffener 436 may be centered at a position on the connector 422 that is equidistant from a center of each of the adjacent apertures 426*a*, 426*b*.

Figure 5:
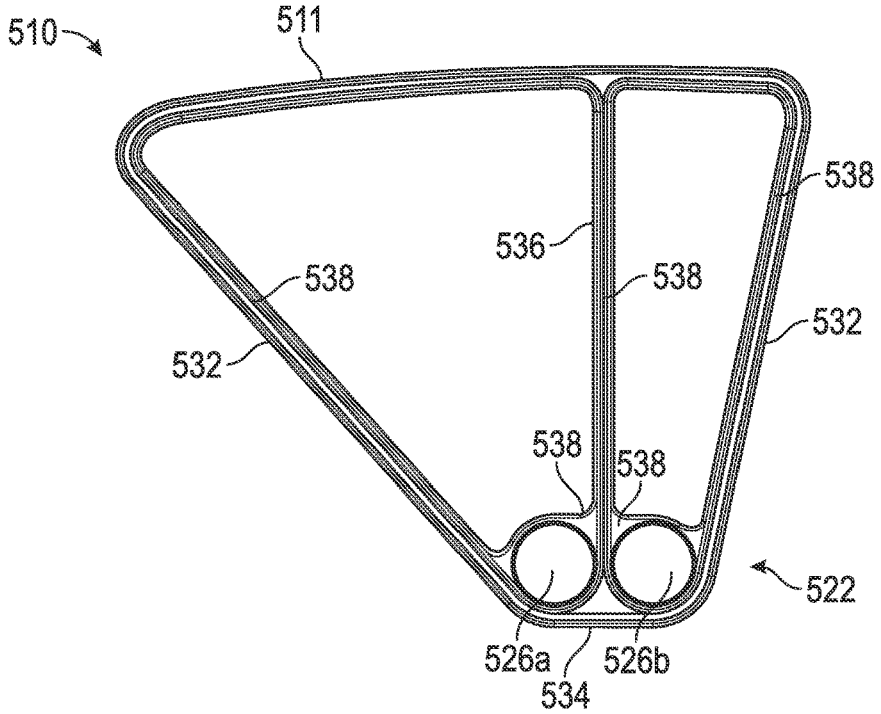
FIG. 5 is a cross-sectional view of a platform in accordance with the present disclosure showing the construction thereof.

Turning now to FIG. 5, a cross-sectional schematic view (rear view) of a platform 510 in accordance with an embodiment of the present disclosure is shown. As shown, an internal structure of the platform 510 is shown. In the embodiment of FIG. 5, the platform 510 is formed from a plurality of layers or plies 538 that are wrapped about a mold, structure, substrate, or preform and then cured to form the platform 510. During the process of manufacture, the apertures 526*a*, 526*b* may be defined by tubes or similar structure that may support the plies 538 as the plies are wrapped to form the structure of the platform 510. As shown, the plies 538 may be used to form the top wall 511, the stiffener 536, the sidewalls 532, and the connector 522.

In accordance with some embodiments, the connectors having adjacent and parallel apertures may be co-molded, such as formed by the plies shown in FIG. 5. Further, in some embodiments, the platform, and specifically the connectors with the parallel apertures, may be made of carbon fiber wrapped around a cylinder to create a tube, i.e., defining the apertures, as shown in FIG. 5. Two tubes can be placed in the layup side by side with vertical stiffener plies traveling between the tubes (e.g., as shown in FIG. 5) bifurcating to wrap around the bottom of each connector and then creating the sidewalls and top wall.

The two parallel apertures, and larger connectors defining a bottom wall, may increase the structural rigidity of the platform. For example, a platform with side-by-side apertures, and the surrounding structure of the connectors, may increase the loadbearing capability of the pins that are inserted into and through the apertures. Further, such a configuration also enables a mechanism for an efficient single vertical stiffener to be located within the platform and extending from a top wall to a connector, between the sidewalls. Moreover, employing two parallel apertures and thus two parallel pins, rotation about a pin centerline may be prevented.

Figure 6:
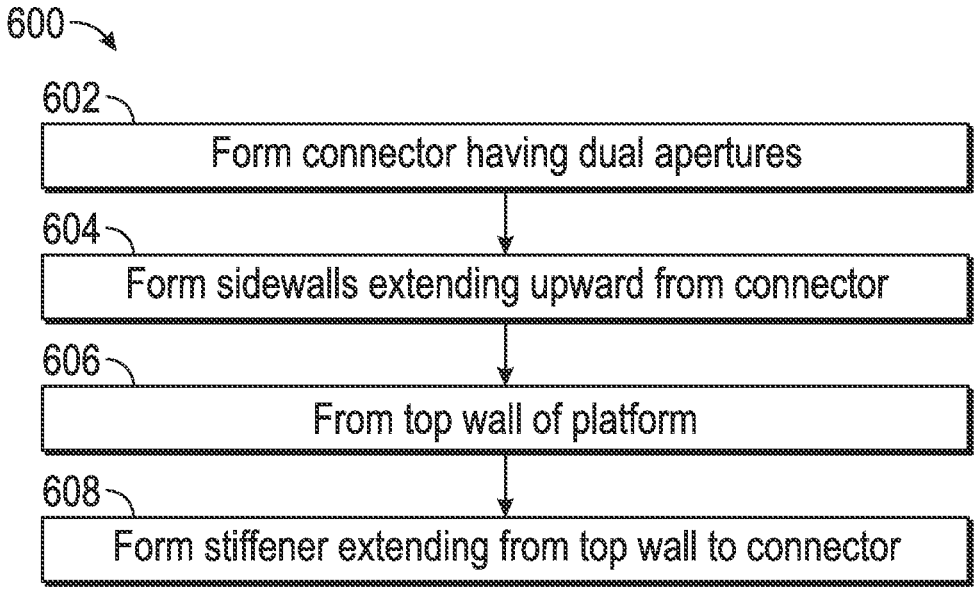
FIG. 6 is a flow process for manufacturing a platform in accordance with an embodiment of the present disclosure.

Turning now to FIG. 6, a process of manufacturing a platform in accordance with a non-limiting embodiment of the present disclosure is show. Process 600 may be employed to form a platform such as that shown in FIGS. 4A-4C or 5, having dual apertures formed in the connectors of the platform.

At block 602, a connector of the platform may be formed having dual apertures therein. This may be casting, molding, additive manufacturing, or other manufacturing technique. In some embodiments, the connector may be formed about two tubes that are aligned in parallel, with plies being wrapped about the tubes. The tubes, after formation, may be removed to leave a platform having two parallel apertures formed in a connector of the platform.

At block 604, sidewalls are formed that extend upward from the connector. At block 606, a top wall is formed wherein the sidewalls are joined to the top wall. At block 608, a stiffener may be formed extending from the top wall to the connector, with the stiffener located between the sidewalls of the platform. In some embodiments, the stiffener may be aligned vertically with respect to the two apertures formed in the connector.

As will be appreciated by those of skill in the art, blocks 602-608 may be performed simultaneously depending on the manufacturing process, such as in molding, casting, or additive manufacturing. Further, in some embodiments, the top wall may be formed first, and the sidewalls and/or the stiffener may extend downward, with the connector being formed last. Thus, the order of the blocks 602-608 is not intended to be limiting, but rather is provided as an example manufacturing flow process. Moreover, additional steps and/or processes may be performed without departing from the scope of the present disclosure.

Advantageously, embodiments described herein provide a platform for a gas turbine engine with side by side co-molded apertures that may increase the loadbearing capability of attachment pins inserted into the apertures while also providing a mechanism for an efficient single vertical stiffener layup. Moreover, two pins in the connectors of the platform may prevent any rotation about a pin centerline.

Advantageously, in accordance with embodiments disclosed herein, two pins can attach a platform supporting an airfoil to a fan rotor within a gas turbine engine. Such configuration may significantly increase the loadbearing capability of the attachment method. Further, in accordance with some embodiments, the pins may be substantially identical, which may eliminate the need for mistake proofing a main pin and an anti-rotation pin. The two pins, advantageously, may create a mechanical lock against tangential rotation of the platform, eliminating the need to balance a center of gravity within a certain distance of the pins. The dual apertures may also allow for an efficient ply layup to incorporate a single vertical stiffener which reduces deflections and stresses in the platform while providing a weight and cost savings over legacy platforms.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although shown and described with respect to a limited number of embodiments and configurations of the platform, those of skill in the art will appreciate that the surfaces of the platforms may take other forms without departing from the scope of the present disclosure.

Accordingly, the present disclosure is not to be seen as limited by the foregoing description, but is only limited by the scope of the appended claims.

What is claimed is:

1. A platform for an airfoil in a gas turbine engine, the platform comprising:

a top wall configured to connect to an airfoil of the gas turbine engine;

two sidewalls extending downward from the top wall;

a connector attached to and connecting the two sidewalls, wherein the top wall, the sidewalls, and the connector define an interior volume of the platform; and a single stiffener extending from the connector to the top wall within the interior volume between the two sidewalls, wherein the connector defines two parallel apertures passing through the connector, wherein the platform has a front end and a rear end, and wherein the two parallel apertures extend through the connector from the front end to the rear end.

2. The platform of claim 1, wherein the two parallel apertures are configured to receive substantially identical pins therethrough.

3. The platform of claim 2, further comprising two substantially identical pins installed in the two parallel apertures.

4. The platform of claim 1, wherein the stiffener is connected to the connector at a point between the two parallel apertures of the connector.

5. The platform of claim 1, wherein the connector defines a bottom wall ofthe platform.

6. A method of manufacturing a platform for an airfoil in a gas turbine engine, the method comprising:

forming a connector of a platform with two parallel apertures passing therethrough;

forming two sidewalls extending upward from the connector;

forming a top wall opposite the connector, wherein the top wall, the sidewalls, and the connector define an interior volume of the platform; and forming a single stiffener extending from the top wall to the connector within the interior volume between the two sidewalls, wherein the platform has a front end and a rear end, and wherein the two parallel apertures are formed to extend through the connector from the front end to the rear end.

7. The method of claim 6, wherein the two parallel apertures are formed to receive substantially identical pins therethrough.

8. The method of claim 7, further comprising installing two substantially identical pins through the two parallel apertures.

9. The method of claim 6, wherein the stiffener is formed to connect to the connector at a point between the two parallel apertures of the connector.

10. The method of claim 6, wherein the connector defines a bottom wall of the platform.

11. The method of claim 6, wherein the top wall, the sidewall, the connector, and the stiffener are formed simultaneously.

12. The method of claim 6, wherein the top wall, the sidewall, the connector, and the stiffener are formed by a layup process.

13. A gas turbine engine comprising:

a rotor;

at least one airfoil; and a platform configured to connect the at least one airfoil to the rotor, the platform comprising:

a top wall configured to connect to an airfoil of the gas turbine engine;

two sidewalls extending downward from the top wall;

a connector attached to and connecting the two sidewalls, wherein the top wall, the sidewalls, and the connector define an interior volume of the platform; and a single stiffener extending from the connector to the top wall within the interior volume between the two sidewalls, wherein the connector defines two parallel apertures passing through the connector, wherein the platform has a front end and a rear end, and wherein the two parallel apertures extend through the connector from the front end to the rear end.

14. The gas turbine engine of claim 13, wherein the two parallel apertures are configured to receive substantially identical pins therethrough.

15. The gas turbine engine of claim 14, further comprising two substantially identical pins installed in the two parallel apertures.

16. The gas turbine engine of claim 13, wherein the stiffener is connected to the connector at a point between the two parallel apertures of the connector.

17. The gas turbine engine of claim 13, wherein the connector defines a bottom wall of the platform.

* * * * *